US011055971B1

(12) United States Patent
de Castro et al.

(10) Patent No.: US 11,055,971 B1
(45) Date of Patent: Jul. 6, 2021

(54) BENDABLE ANTI-SKIMMING PLATE FOR A CARD READER

(71) Applicant: Diebold Nixdorf, Incorporated, North Canton, OH (US)

(72) Inventors: Marcelo Soares de Castro, Canton, OH (US); Christian Beine, Paderborn (DE); Shawn Griggy, Canton, OH (US)

(73) Assignee: Diebold Nixdorf, Incorporated, North Canton, OH (US)

( * ) Notice: Subject to any disclaimer, the term of this patent is extended or adjusted under 35 U.S.C. 154(b) by 0 days.

(21) Appl. No.: 16/831,669

(22) Filed: Mar. 26, 2020

Related U.S. Application Data

(60) Provisional application No. 62/824,004, filed on Mar. 26, 2019, provisional application No. 62/824,009, filed on Mar. 26, 2019.

(51) Int. Cl.
*G07F 19/00* (2006.01)
*G07F 7/08* (2006.01)

(52) U.S. Cl.
CPC ..... *G07F 19/2055* (2013.01); *G07F 7/0873* (2013.01)

(58) Field of Classification Search
CPC ..... G07F 7/0873; G07F 19/2055
USPC ..... 235/379; 705/43
See application file for complete search history.

(56) References Cited

U.S. PATENT DOCUMENTS 9,818,049 B2 11/2017 Goedee et al.
10,325,186 B2 6/2019 Goedee et al.
2019/0213845 A1* 7/2019 Goedee ..... G07F 7/0873

* cited by examiner

*Primary Examiner* — Suezu Ellis
(74) *Attorney, Agent, or Firm* — Black, McCuskey, Souers & Arbaugh LPA

(57) ABSTRACT

A card reader includes a user-card-insertion slot operatively connected to user-card path. A data-reader is located in an interior of the card reader. A plate is located in the interior of the card reader. The plate is adjacent to the data-reader and interior to the user-card-insertion slot. The plate is configured to block the insertion of a skimming or shimming device and to bend during an attempt to remove the plate from the interior of the card reader. The plate may be configured such that a power connection between the plate and a circuit supplying power to the card reader may be broken during an attempt to remove the plate from the interior of the card reader.

18 Claims, 14 Drawing Sheets

BENDABLE ANTI-SKIMMING PLATE FOR A CARD READER

CROSS-REFERENCE TO RELATED APPLICATIONS

This application claims the benefit of and priority to U.S. Provisional Application No. 62/824,004, filed Mar. 26, 2019, and U.S. Provisional Application No. 62/824,009, filed Mar. 26, 2019, the contents of which are hereby incorporated by reference in their entirety.

BACKGROUND

This relates generally to card readers. A card reader is a device that reads information from a card, such as a credit card or debit card, or identification or security card, or the like.

Card readers may be used in a number of devices, including, but not limited to automated transaction machines, point of sale systems, security systems, and identification systems. In the case of automated transaction machines, the machines may include automated banking machines, automated teller machines, financial or commercial self-service terminals, and other machines and systems that may automatedly carry out transactions, including transactions of value. Generally, a card reader operates to read data from an information hearing device such as a card, which may include a magnetic strip or chip or other device containing information or a QR code or UPC code or other device representative of such information. For an example, an automated transaction machine may operate to cause the data read from a card to be compared with other computer stored data related to a user and, if the data is validated, permit a transaction to take place, such as, for example, a withdrawal of funds.

It is known that sometimes bad actors, attempting to obtain data from cards, may insert devices into card readers. These devices, once disposed in the interior of card readers or about the card reader, may obtain data to transmit to or record for retrieval by the bad actor. Third parties reading, intercepting, or obtaining, data in such a manner is known as skimming or shimming. Often these bad actors use the data obtained by skimming or shimming to purchasing goods or services with the funds or credit of the user, or to simply transfer funds or credit of the user. Some skimming and shimming devices may be of such size and shape that can be placed within the interior of a card reader such that, even with the shimming or they skimming device in place, a card may still be inserted into the card reader and read by the card reader.

SUMMARY

This relates more specifically to apparatuses, systems, and methods for tamper resistant card readers.

In at least one embodiment, a card reader includes a user-card-insertion slot operatively connected to a user-card path. A data-reader is located in an interior of the card reader, and a plate is located in the interior of the card reader. The plate is adjacent to the data-reader and the user-card path. The plate is configured to block insertion of a skimming or shimming device, and the plate is configured to bend during an attempt to remove the plate from the interior of the card reader. Such a plate may include at least one bend zone, which may, for example, include perforations, micro-holes, or a relatively thin area of plate. As such, the plate may be configured to break during an attempt to remove the plate from the interior of the card reader. Further, the card reader may be configured such that the plate cannot be removed from the card reader without taking the card reader out of service. Additionally, the card reader may be configured to be inoperable due to the bending of the plate.

In at least one other embodiment, a card reader includes a user-card-insertion slot operatively connected to a user-card path. A data-reader is located in an interior of the card reader, and a plate located in the interior of the card reader. The plate is adjacent to the data-reader and to the user-card path. The plate is configured to block an insertion of a skimming or shimming device. The plate is operatively connected to a circuit supplying power to the card reader, and the plate is configured such that the connection between the plate and the circuit supplying power to the card reader is broken during an attempt to remove the plate from the interior of the card reader. The plate may be operatively connected to the circuit by a cable. The plate may form part of the electrical connection to the circuit.

In at least one other embodiment, an automated transaction machine includes a fascia, a card reader, and a user-card-insertion slot operatively connected between the fascia and a space in the interior of the card reader. A data-reader is located in an interior of the card reader, and a plate is located in the interior of the card reader. The plate is adjacent to the data-reader and to the user-card path. The plate is configured to block the insertion of a skimming or shimming device, and the plate is configured to bend during an attempt to remove the plate from the interior of the card reader.

In at least one other embodiment, a plate capable of insertion into an interior of a card reader is configured such that when inserted into a card reader the plate blocks insertion of a skimming or shimming device and the plate is configured to bend during an attempt to remove the plate from the interior of the card reader. The plate may be configured such that it cannot be removed from the card reader without taking the card reader out of service. The plate may be configured such that the bending of the plate causes the card reader to be inoperable.

In at least one embodiment, a method of preventing fraud includes placing in a card reader a plate with at least one bend zone, placing the plate adjacent to a data-reader and a user-card path, the plate blocking an insertion of a skimming or shimming device, and the plate bending in at least one bend zone when an attempt is made to remove the plate from the interior of the card reader. The method may further include that the card reader becomes not operable due to the bending of the plate. The method may further include that the card reader jams due to the bending of the plate. The method may further include that a portion of the plate breaks when an attempt is made to remove the plate from the interior of the card reader.

In at least one other embodiment, a method of preventing fraud includes placing a plate in a card reader adjacent to a data-reader and a user-card path, and operatively connecting the plate to a circuit supplying power to the card reader, where the plate is configured to block an insertion of a skimming or shimming device and is configured to break the connection between the plate and the circuit supplying power to the card reader during an attempt to remove the plate from the interior of the card reader.

It should be understood that embodiments above or features of more than one embodiment may be combined as desired.

DETAILED DESCRIPTION

Figure 1:
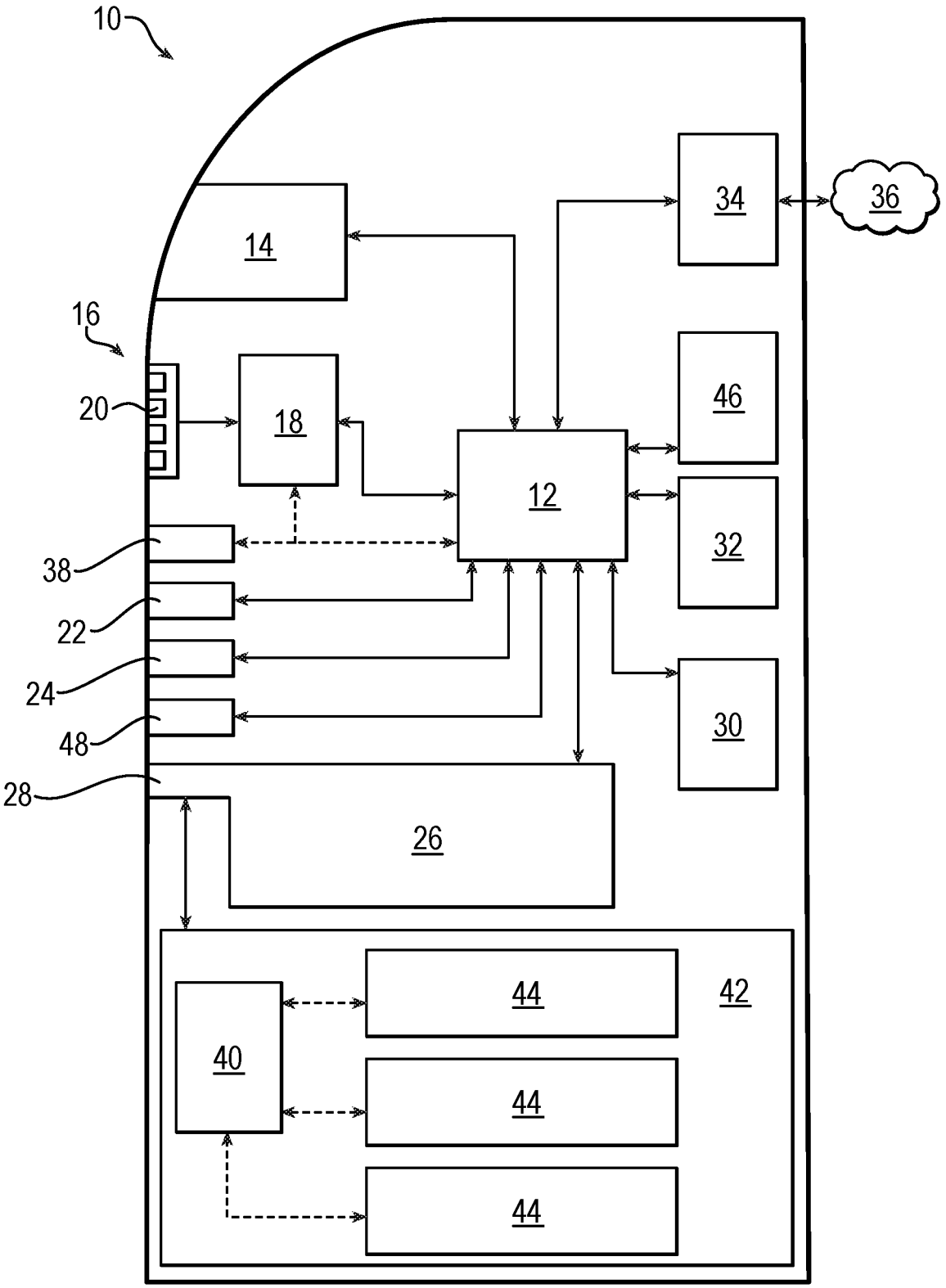
FIG. 1 is a functional block diagram of an automated transaction machine (ATM) according to a first embodiment.

A plurality of different embodiments are shown throughout the Figures. Similar element have been identified with similar identifiers. Furthermore, it should be understood that it is intended that particular features of one embodiment may be combined with one or more features of other embodiments.

In at least one embodiment a card reader includes a user-card-insertion slot operatively connected to a user-card path. A data-reader is located in an interior of the card reader, and a plate is located in the interior of the card reader adjacent to the data-reader and the user-card path. The plate is formed and configured to block insertion of a skimming or shimming device into the interior of the card reader, and the plate is formed and configured with a pre-weakened area defining a bend zone to bend during an attempt to remove the plate from the interior of the card reader. The pre-weakened area defining the bend zone may include perforations, micro-holes, and/or a portion of plate thin relative to a remaining thickness of the plate. Thus, the plate may be formed and configured to deform or break during an attempt to remove the plate from the interior of the card reader. It may be a result that the card reader is inoperative or unserviceable due to the deformation or breakage of the plate.

In at least one embodiment a card reader includes a user-card-insertion slot operatively connected to a user-card path. A data-reader is located in an interior of the card reader, and a plate located in the interior of the card reader. The plate is adjacent to the data-reader and to the user-card path. The plate is formed and configured to block an insertion of a skimming or shimming device into the interior of the card reader. The plate is electrically connected to a circuit supplying power to the card reader, such that when the connection between the plate and the circuit supplying power to the card reader is broken, such as during an attempt to remove the plate from the interior of the card reader, the card reader becomes inoperative. The plate may be operatively connected to the circuit by a cable. Thus, in at least one embodiment, the plate forms at least a portion of the electrical connection to the circuit.

In at least one embodiment, an automated transaction machine includes a fascia, and a card reader with a user-card-insertion slot operatively connected to the fascia and to a user-card path between the user-card insertion slot and a data-reader located in an interior of the card reader. A plate is disposed in the interior of the card reader adjacent to the data-reader and to the user-card path. The plate is configured to block the insertion of a skimming or shimming device into the interior of the card reader, and the plate is configured to bend, deform or break during an attempt to remove the plate from the interior of the card reader.

One expected benefit of at least one of the exemplary embodiments is securing a card reader from fraudulent obtaining of user data stored on user cards, including, for example, reduction of successful skimming attacks where magnetic information on a user card is stolen and duplicated on a "clone card" which is then utilized to perform fraudulent transactions. A further expected benefit of at least one exemplary embodiment is that, when a bad actor attempts to remove a plate in accordance herewith from a card reader (such as by, for example, inserting a pulling tool into a card reader with such a plate and attempting to pull the plate from the card reader so that a fraudulent device can be placed within the card reader), the pulling tool will bend, deform, and/or break the plate and the plate, in whole or in part, will remain in the card reader, thus rendering the card reader inoperative or unserviceable, for example, with the interior transport pathway for a user card jammed, and thereby inhibiting or preventing the insertion and/or use of a fraudulent device, such as a skimmer or shimmer, within the card reader. Additionally, a further expected benefit of at least one exemplary embodiment is that once the card reader is jammed, it cannot be further used by users and additional cards will not be inserted into the interior of the card reader until the card reader is repaired, thereby reducing the risk that such cards will be the subject of a skimming or shimming device placed within or about the card reader.

Referring now to the drawings, there is shown an automated transaction machine (ATM) 10 in accordance with at least one embodiment.

Generally, Automated transaction machines (ATMs) are commonly used to carry out a variety of financial or commercial transactions. Most commonly, these transactions include dispensing cash, checking account balances, paying bills and/or receiving deposits from users. ATMs may also perform a variety of other transactions, including the sale and purchase of tickets, issuance of coupons, check or voucher presentation, the printing of script, and a variety of other functions.

For carrying out these transactions or performing these functions, ATMs typically include a variety of components, and these components are chosen based upon what is necessary to include for the particular design and build of a particular production line or model of machine. Because the transactions may include items of significant value, security and safekeeping of the documents, currency, and other materials is important.

The ATM 10 includes structures and subsystems for receiving input from a user and executing transactions. The ATM 10 includes a computing device 12. The computing device 12 has one or more processors and a non-transitory, computer readable medium. The computing device 12 operates under the control of an operating system, kernel, and/or firmware and executes or otherwise relies upon various computer software applications, components, programs, objects, modules, data structures, etc. The computing device 12 can operate under the control of the Windows® operating system. The computer readable medium (memory) of the computing device 12 can include random access memory (RAM) devices including the main storage of computing device 12, as well as any supplemental levels of memory, e.g., cache memories, non-volatile or backup memories (e.g., programmable or flash memories), read-only memories, etc. In addition, the memory may be considered to include memory storage physically located elsewhere from RAM in the computing device 12, such as any cache memory in a processor, as well as any storage capacity used as a virtual memory. The computing device 12 can also include one or more mass storage devices, e.g., a floppy or other removable disk drive, a hard disk drive, a direct access storage device (DASD), an optical drive (e.g., a CD drive, a DVD drive, etc.), and/or a tape drive, among others, represented by memory 46.

The ATM 10 also includes a display 14. The computing device 12 can control the display 14 to present information to the user for furthering completion of the transaction. The display 14 can be a touch screen that allows the user to enter information through the display 14. The display 14 is configured to transmit any user-entered information to the computing device 12.

The ATM 10 also includes a keypad 16 and an encryption module 18. Generally, the combination of a keypad and an encryption module are referred to in the art as an encrypted pin pad (EPP). The keypad 16 includes a plurality of keys, such as key 20. The encryption module 18 has one or more processors and a non-transitory, computer readable medium. The user can press the keys of the keypad 16 to enter a Personal Identification Number (PIN). The keypad 16 is placed in communication with the encryption module 18 and therefore the numbers of the PIN are received by the encryption module 18. It is noted that the communication of the PIN is direct and secure, the PIN cannot be intercepted between the keypad 16 and the encryption module 18. The PIN is then encrypted by the encryption module 18 to define a PIN block. The encryption module 18 includes a network encryption key and applies the network encryption key to encrypt the PIN to the PIN block. The encryption module 18 is configured to transmit the PIN block to the computing device 12, which can direct the PIN block away from the ATM 10 during the completion of a financial transaction.

The ATM 10 also includes a card module or card reader 22. The card reader 22 can receive a token from the user, such as a card and can be motorized or non-motorized. The card reader 22 can be configured to execute read and write operations with respect to any storage medium fixed to the user's card. The card reader 22 can be configured to read data from a magnetic strip on the back of a card or a chip embedded in the card. The card reader 22 can be configured to transmit any data read from the user's card to the computing device 12, which can direct the data read from the card away from the ATM 10 during completion of a financial transaction. The card reader 22 can also be configured to receive commands and data from the computing device 12 and change data stored on the user's card.

The ATM 10 also includes a printer module 24. The computing device 12 can control the printer module 24 to print a receipt when a transaction has been completed. The printer module 24 can communicate one or more messages to the computing device 12, such as a maintenance message regarding the need to refill printer paper.

The ATM 10 also includes an article exchange unit 26. In the exemplary embodiment, the article exchange unit 26 is configured to receive items such as checks. The article exchange unit 26 can include a drum on which received items are stored. The article exchange unit 26 includes a slot 28 open to an exterior of the ATM 10 for the receipt of such items. In other embodiments, an article exchange unit can be configured to facilitate the receipt of other items, different than paper. The article exchange unit 26 can include one or more sensors and transmit signals from any such sensors to the computing device 12 to execute an exchange. The computing device 12 can control the article exchange unit 26 in response to such signals. For example, the article exchange unit 26 can include a sensor that detects receipt of an item such as a check. The article exchange unit 26 can include a further sensor in the form of a scanner that generates an image of the received item and transmits the image to the computing device 12. When an exchange involves the dispensation of an article to the user, the computing device 12 can control the article exchange unit 26 to dispense the item(s) requested by the user.

The ATM 10 also includes a printer module 30. The printer module 30 can generate a continuous record of all transactions executed by the ATM 10. The computing device 12 can control the printer module 30 to supplement the record after each transaction has been completed. The printer module 30 can communicate one or more messages to the computing device 12, such as a maintenance message regarding the need to refill printer paper.

The ATM 10 also includes an access module 32. The access module 32 can be positioned proximate to a rear side of the ATM 10. The access module 32 can be utilized by service and support technicians. For example, the access module 32 can be utilized by a field engineer to complete software updates to the computing device 12. The access module 32 can also be utilized when non-software updates and maintenance is performed, such as the refilling of printer paper or currency.

The ATM 10 also includes a transceiver 34. The transceiver 34 is configured to facilitate communication between the computing device 12 and other computing devices that are distinct from and physically remote from the computing device 12. An example of such a remote computing device is a server computing device, such as a banking or financial institution server communicating with a plurality of ATMs. The transceiver 34 places the computing device 12 in communication with one or more networks, such as network 36. The network 36 can be a local area network (LAN), a wide area network (WAN) such as the Internet, a Multiprotocol label switching (MPLS) network, a cellular network such as operated by cellular phone companies, or any combination thereof. The network 36 can be a financial/bank network such as NYCE, PULSE, PLUS, Cirrus, AFFN, Interac, Interswitch, STAR, LINK, MegaLink, or BancNet. The transceiver 34 can transmit data and requests for input generated by the computing device 12 and receive responses to these requests, directing these responses to the computing device 12.

The ATM 10 also includes a transceiver 38. The transceiver 38 is configured to facilitate communication between at least one of the encryption modules 18 and the computing device 12 and other computing devices that are distinct from and physically proximate to the ATM 10. An example of such a proximate computing device is a smartphone possessed by the user. The dashed connection lines in FIG. 1 represent optional interconnections. The transceiver 38 can place the user's smartphone in communication with the encryption module 18, the computing device 12, or both. The transceiver 38 can implement various communication protocols. For example, the transceiver 38 can be a Near Field Communication (NFC) device. Alternatively, the transceiver 38 can be a Bluetooth beacon. The transceiver 38 can transmit and receive data and requests for input generated by the encryption module 18 and/or the computing device 12, such transmissions occurring with the user's smart phone for example.

The ATM 10 also includes an advanced function dispenser (AFD) 40. The AFD 40 can dispense banknotes, such as currency. The AFD 40 is positioned in a safe 42. One or more cassettes or cash boxes 44 are also positioned and protected in the safe 42. Banknotes are stored in the cassettes 44 for disbursement to a user of the ATM 10. The AFD 40 can extract the banknotes from one or more of the cassettes 44 and direct them out of the ATM 10 through the slot 28. The AFD 40 thus communicates with the slot 28 in parallel with the article exchange unit 26. The AFD 40 can communicate with and be controlled by the computing device 12 for at least some operations. Each of the cassettes 44 can engage the AFD 40 through a rack whereby the positioning of the cassettes is controlled. Further, each of the cassettes 44 and the AFD 40 can include mating connectors of any form, whereby a positive interconnection is confirmed electronically. When one or more of the cassettes 44 and the AFD 40 are not properly interconnected, a signal or lack thereof can be communicated to the computing device 12 whereby an error message is generated, or the ATM 10 can be disabled.

Figure 2:
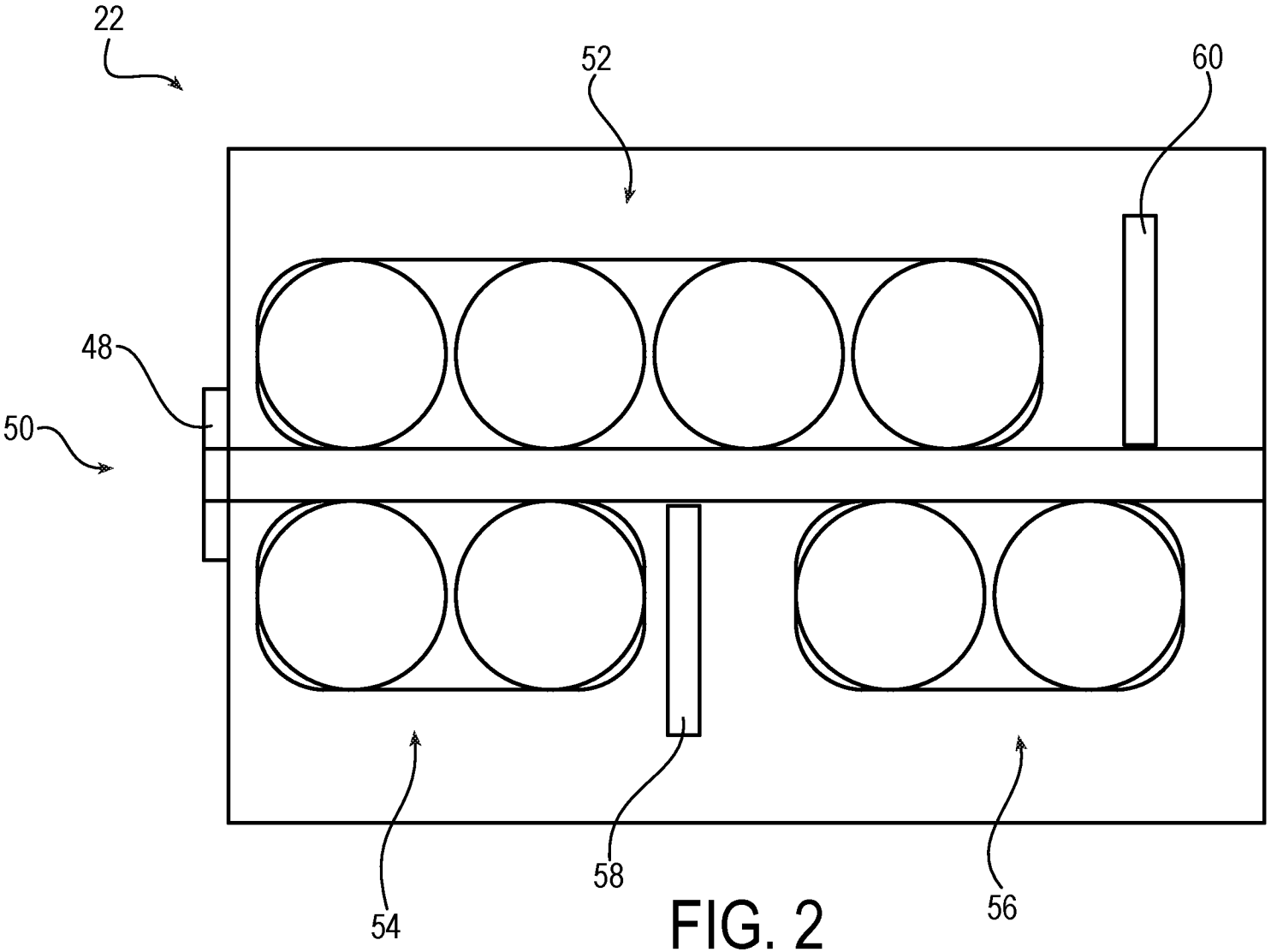
FIG. 2 is a schematic diagram of the card reader of the ATM of FIG. 1.

As best shown in FIG. 2 the card reader 22 includes a user-card-insertion slot 48 exposed on the front face of the ATM 10. A user can insert a card in the user-card-insertion slot 48. The card reader 22 defines a card path (i.e., a path of movement of the card) referenced by spaced, dash lines at 50. The card path 50 includes a space in the interior of the card reader sufficient for the insertion of a user card. The card reader 22 also includes a plurality of conveyor members 52, 54, and 56 configured to move the card along card path 50. The conveyor members 52, 54, and 56 may be motorized, and may be configured to selectively convey a user card in the forward or backward direction.

The card reader 22 also includes data readers, such as card-reading heads 58 and 60. The card-reading head 58 is positioned along the card path 50 and configured to read data held on a magnetic strip on an underside a user card. The card-reading head 60 is positioned along the card path 50 and is configured to read data held on a chip embedded in a user card.

The card reader 22, in conjunction with card-reading head 58 and/or card-reading head 60, is operative to read data bearing records presented by machine users. The records can include data corresponding to at least one of the associated user, one or more user financial accounts, and/or other data. In some exemplary embodiments, the card reader 22 can read the data from magnetic strip cards. In other exemplary embodiments, the card reader 22 can be operative to read data from oilier card or record types such as contactless cards. Of course, these approaches are exemplary.

Figure 3:
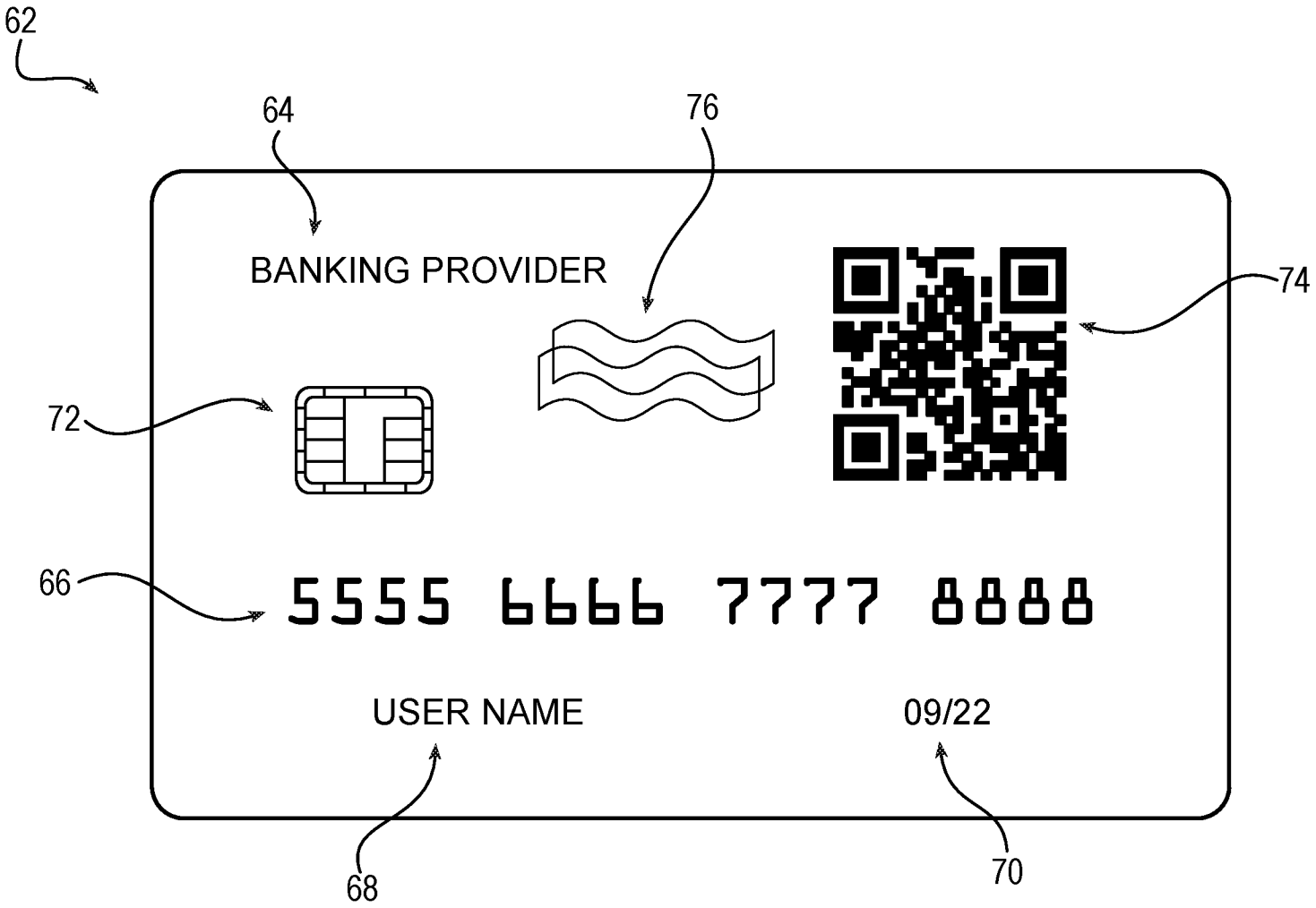
FIG. 3 is a front view of a user card for use with the ATM of FIG. 1.

Shown in FIG. 3 is an exemplary user card 62. The user card 62 displays various indicia. First indicium 64 is the name of the issuer of the card. Second indicium 66 is an account number. Third indicium 68 is the card holder's name. Fourth indicium 70 is the date of expiration of the user card. The user card 62 also includes an integrated circuit or chip 72, storing information. The user card 62 also includes fifth indicium 74 in the form a QR code. The user card 62 also includes a magnetic strip on the back, which is therefore not visible of FIG. 3. The user card 62 also includes a holographic sixth indicium 76. In other exemplary embodiments, user card 62 may include more or less indicia then set forth above.

Figure 4:
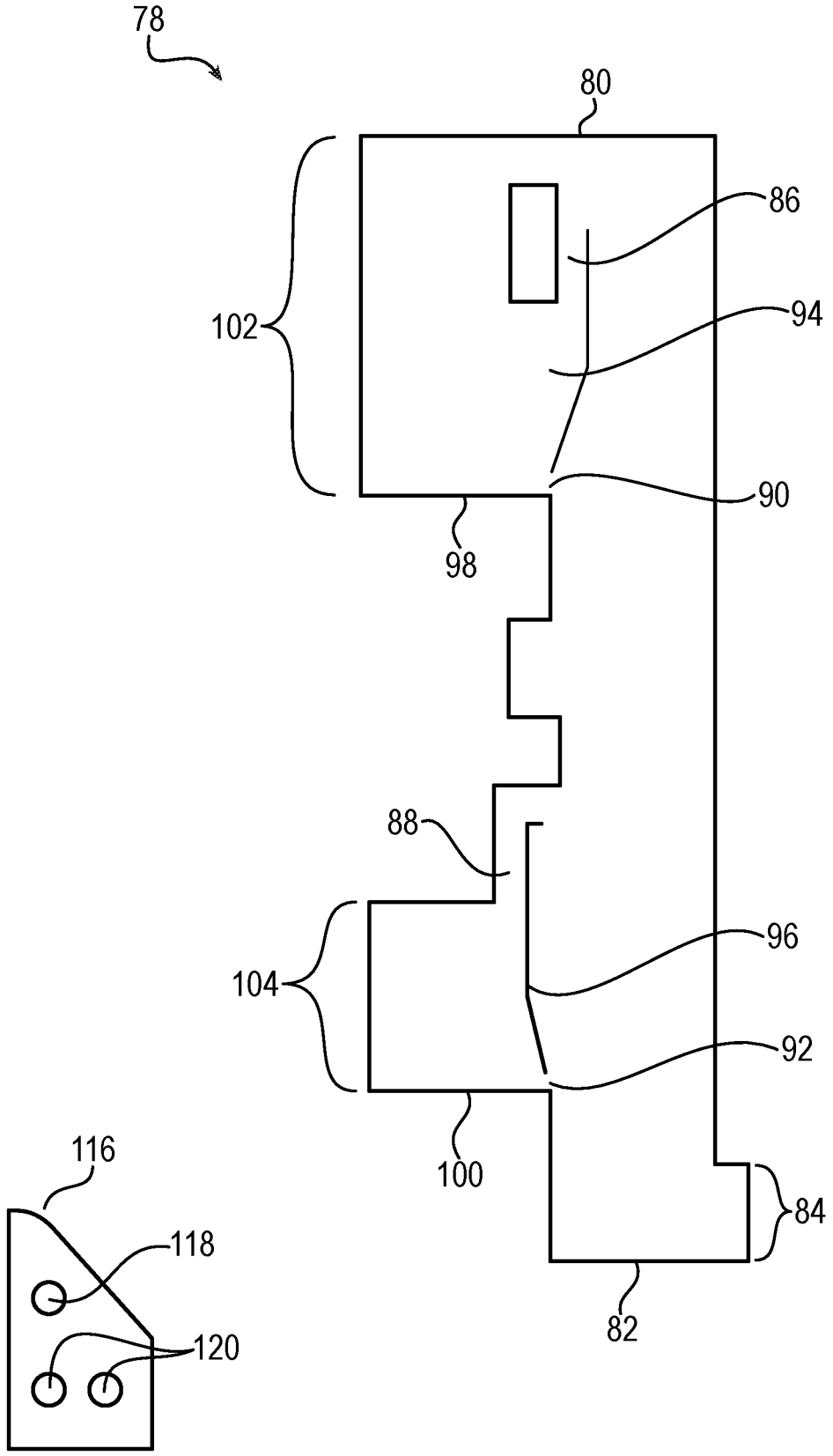
FIG. 4 is a top schematic diagram of a plate and a sheet for insertion into the card reader of FIG. 2.

As shown in FIG. 4, a plate 78 is capable of being inserted into the interior of the card reader 22. The plate 78 can be inserted adjacent to one or more of the data-readers 58 or 60 and adjacent to the user-card path 50. The plate 78 is configured such that, when inserted into the interior of the card reader 22, the plate 78 blocks insertion of a skimming or shimming device into the interior of the card reader 22 in spaces covered by plate 78. In one method of installation, the plate 78 will be inserted into the card reader 22 while the card reader 22 is out of service by inserting the plate 78 through the back of the card reader 22 along the card path 50. When inserted into the card reader 22, the plate 78 sits below the card path 50 and covers various areas below the card path 50 where a skimming or shimming device could otherwise be placed.

In one embodiment the plate 78 is made of stainless steel. In other embodiments the plate 78 is made of plastic, nylon, or any other material sufficiently strong for forming a relatively rigid base below the card path 50 while also being thin enough to permit the transport of the user card 62 along the card path 50 while the plate 78 is within the interior of the card reader 22.

In at least one exemplary installation, the plate 78 spans a majority of the length of the card path 50 when the plate 78 is placed within the card reader 22. The front-facing side of plate 78 (i.e., the side facing user-card-insertion slot 48 when plate 78 is placed within card reader 22) is identified as reference number 80 on FIG. 4. The back-facing side of plate 78 is identified as reference number 82 on FIG. 4.

In certain embodiments, a relatively-wide tab 84 is located on the back-facing side of the plate 78. When the plate 78 is placed within the card reader 22, the relatively-wide tab 84 is located outside of the card path 50 at the back of the card reader 22 and abuts part of the physical structure of the card reader 22. In certain exemplary embodiments, the relatively-wide tab 84 is also affixed to the outside of the card reader 22 by certain attachment mechanisms, including by placing the end of the relatively-wide tab 84 through an orifice 118 in a sheet 116 which is affixed to the outside of the card reader 22. The sheet 116 can be made of metal or any other suitable material, and can be affixed to the card reader 22 by any suitable mechanism to retain the sheet 116 to the card reader 22, including by screwing screws into the card reader 22 through orifices 120 in the metal sheet 116. The relatively-wide tab 84 prevents the plate 78 from being pulled through the entire length of the card path 50, including being pulled out of the front of the card reader 22 through the user-card-insertion slot 48. An exemplary relatively-wide tab 84 can be approximately 2.5 cm wide measured from front to back longitudinally along the plate 78, although such can constitute other widths sufficient to hold the plate 78 in place within the card path 50.

The plate 78 includes at least two bend zones, 86 and 88. The plate 78 also includes at least two break zones, 90 and 92. The plate 78 also includes cut areas 94 and 96 where cuts have been made through the plate 78. Such cut areas can be made by, for example, laser-cutting, perforating, indenting, punching, or other mechanism to pre-weaken a portion of the plate 78.

It is believed that bad actors may sometimes attempt to remove anti-skimming and/or anti-shimming plates from card readers by inserting a removal tool through a user-card-insertion slot in a card reader, and attempt to utilize such tool to "grab" relatively wide areas of such plates and then pull such plates out of the front of the card reader. For purposes of illustration, two relatively-wide edges are identified as reference numbers 98 and 100 on FIG. 4.

In at least one example, the plate 78 is configured such that when a bad actor attempts to pull the plate 78 out of the card reader 22 by pulling on the relatively-wide edge 98 with sufficient force, the break zone 90 will break and "connect" to the cut area 94 such that the cut area 94 will extend to an edge of the plate 78. In some embodiments, such cut area could extend to the relatively-wide edge 98. The plate 78 is configured such that, as the bad actor continues to pull, the bend zone 86 will bend or twist and bended area 102 will bend, twist, or curl in substantially the direction that the plate 78 is being pulled. In the above example, the bended area 102 will bend, twist, or curl towards the front 80 of the plate 78. In some further examples, the plate 78 is configured such that the bended area 102 will bend, twist, or curl such a way that the plate 78 cannot be removed from the card reader 22. In other examples, the plate 78 is configured such that the bended area 102 will bend, twist, or curl in such a way that the plate 78 cannot be removed from the card reader 22 without taking the card reader 22 out of service. In other examples, the card reader 22 will not operable due to the bending of the plate 78.

In another example, a bad actor may attempt to pull on the second relatively-wide edge 100 instead of the first relatively-wide edge 98. In such example, the plate 78 is configured such that the break point 92, the laser cut 96, the bend zone 88, and the bended area 104 will act similarly to the areas discussed in the preceding paragraph.

Figure 5:
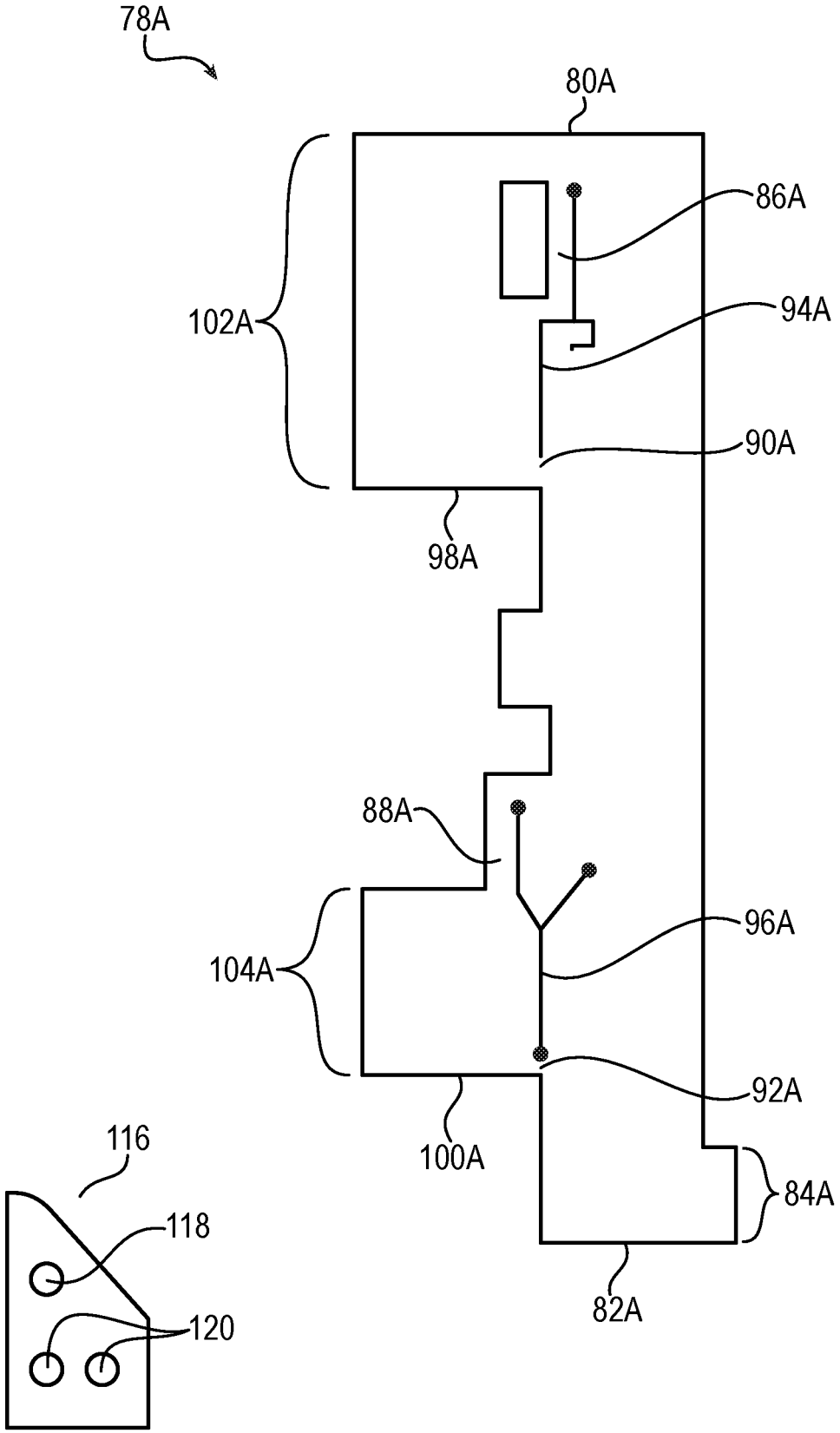
FIG. 5 is a top schematic diagram of an alternative embodiment of a plate and a sheet similar to FIG. 4.

There is shown in FIG. 5 another embodiment of a plate 78A capable of being inserted into the interior of the card reader 22. The plate 78 can be inserted adjacent to the data-reader 58 or 60 and to the user-card path 50. The plate 78A is configured such that, when inserted into the interior of the card reader 22, the plate 78A blocks insertion of a skimming or shimming device into card reader in spaces covered by the plate 78A. In one method of installation, the plate 78A will be inserted into the card reader 22 while the card reader 22 is out of service by inserting plate 78A through the back of the card reader 22 along the card path 50. When inserted into the card reader 22, the plate 78A sits below the card path 50 and covers various areas under the card path 50 where a skimming or shimming device could otherwise be placed.

The plate 78A may be made of stainless steel. The plate 78A also may be made of plastic, nylon, or any sufficiently strong material for forming a relatively rigid base below the card path 50 while also being thin enough to permit the transport of the user card 62 along the card path 50 above the plate 78 while the plate 78 is within the interior of the card reader 22.

The plate 78A may span the majority of the length of the card path 50 when the plate 78A is placed within the card reader 22. The front-facing side of the plate 78A (i.e., the side facing the user-card-insertion slot 48 when the plate 78A is placed within card reader 22) is identified as reference number 80A on FIG. 5. The back-facing side of the plate 78A is identified as reference number 82A on FIG. 5.

In certain embodiments, a relatively-wide tab 84A is located on the back-facing side of the plate 78A. When the plate 78A is placed within the card reader 22, the relatively-wide tab 84A is located outside of the card path 50 at the back of the card reader 22 and abuts part of the physical structure of the card reader 22. In certain exemplary embodiments, the relatively-wide tab 84A is also affixed to the outside of the card reader 22 by certain attachment mechanisms, including by placing the end of the relatively-wide tab 84A through an orifice 118 in the sheet 116 which is affixed to the outside of the card reader 22. The sheet 116 may be made of metal or any other suitable material, and can be affixed to the card reader 22 by any suitable fixing mechanism, such as screwing screws into the card reader 22 through orifices 120 in the metal sheet 116. The relatively-wide tab 84A prevents the plate 78A from being pulled through the entire length of the card path 50, including being pulled out of the front of the card reader 22 through the card-insertion slot 48. An exemplary relatively-wide tab 84A can be approximately 2.5 cm wide measured from front to back longitudinally along the plate 78A, although such can constitute other widths sufficient to hold the plate 78A in place within the card path 50.

The plate 78A includes at least two bend zones, 86A and 88A. The plate 78A also includes at least two break zones, 90A and 92A. The plate 78A also includes cut areas 94A and 96A where cuts have been made through the plate 78A. Such cut areas can be made by, for example, laser-cutting, perforating, punching, indenting, or other mechanism sufficient to pre-weaken a portion of the plate 78A.

It is believed that bad actors may sometimes attempt to remove anti-skimming and/or anti-shimming plates from card readers by inserting a removal tool through a user-card-insertion slot in a card reader, and attempt to utilize such tool to "grab" relatively wide areas of such plates and then pull such plates out of the front of the card reader. For purposes of illustration, two relatively-wide edges are identified as reference numbers 98A and 100A are identified on FIG. 5.

In an example, the plate 78A is configured such that when a bad actor attempts to pull the plate 78A out of the card reader 22 by pulling on the relatively-wide edge 98A with sufficient force, the break zone 90A will break and "connect" to the cut area 94A such that the cut area 94A will extend to an edge of the plate 78A. In certain embodiments, the plate 78A is configured such that such cut area could extend to the relatively-wide edge 98A. As the bad actor continues to pull, the plate 78A is configured such that the bend zone 86A will bend or twist and the bended area 102A will bend or twist in substantially the direction that the plate 78A is being pulled. In some examples, the plate 78A is configured such that the bended area 102A will bend, twist, or curl towards the front of the plate 78A. In some examples, the plate 78A is configured such that the bended area 102A will bend, twist, or curl such a way that the plate 78A cannot be removed from the card reader 22. In other examples, the plate 78A is configured such that the bended area 102A will bend, twist, or curl in such a way that the plate 78A cannot be removed from the card reader 22 without taking the card reader 22 out of service. In other examples, the card reader 22 is not operable due to the bending of the plate 78A.

In another example, a bad actor may attempt to pull on the second relatively wide edge 100A instead of the first relatively wide edge 98A. The plate 78A is configured such that, in such example, the break point 92A, the laser cut 96A, the bend zone 88A, and the bended area 104A will act similarly to that discussed in the preceding paragraph.

In an exemplary embodiment, the force necessary to break the plate 78 at the break point 90 or the break point 92 is less than the force necessary to break the relatively-wide tab 84. In such exemplary embodiment, the force necessary to bend the plate 78, for example, at the bend areas 102 or 104, is less than the force necessary to break the relatively-wide tab 84. In another exemplary embodiment, the force necessary to break the plate 78A at the break point 90A or 92A is less than the force necessary to break the relatively-wide tab 84A. In such exemplary embodiment, the force necessary to bend the plate 78A, for example, at the bend areas 102A or 104A, is less than the force necessary to break the relatively-wide tab 84A. In the above exemplary embodiments, when a bad actor pulls on the plate 78 or the plate 78A, the plate 78 or 78A will be held in place by the relatively wide tab 84 or the relatively wide tab 84A and such plates will bend at the respective bend zone that is being pulled on by the bad actor.

In the above embodiments, certain characteristics of bend zones, break zones, relatively-wide tabs, and cut areas, are merely exemplary, and it should be understood that these may be altered as desired or required.

Figure 6:
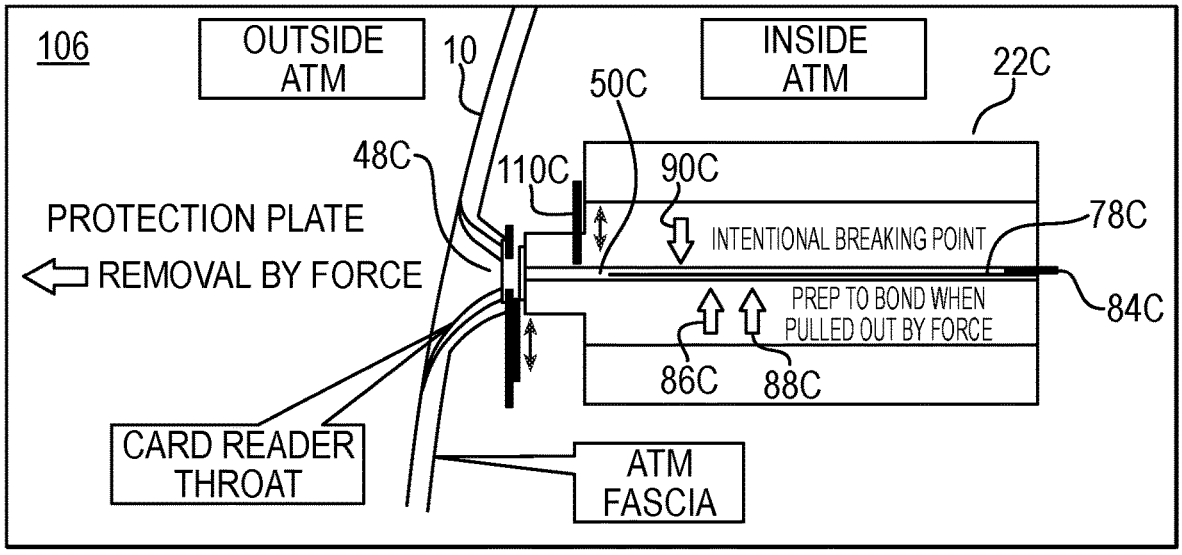
FIG. 6 is a schematic diagram of a portion of the ATM of FIG. 1 with the card reader of FIG. 2 and the plate of FIG. 4.
Figure 6:
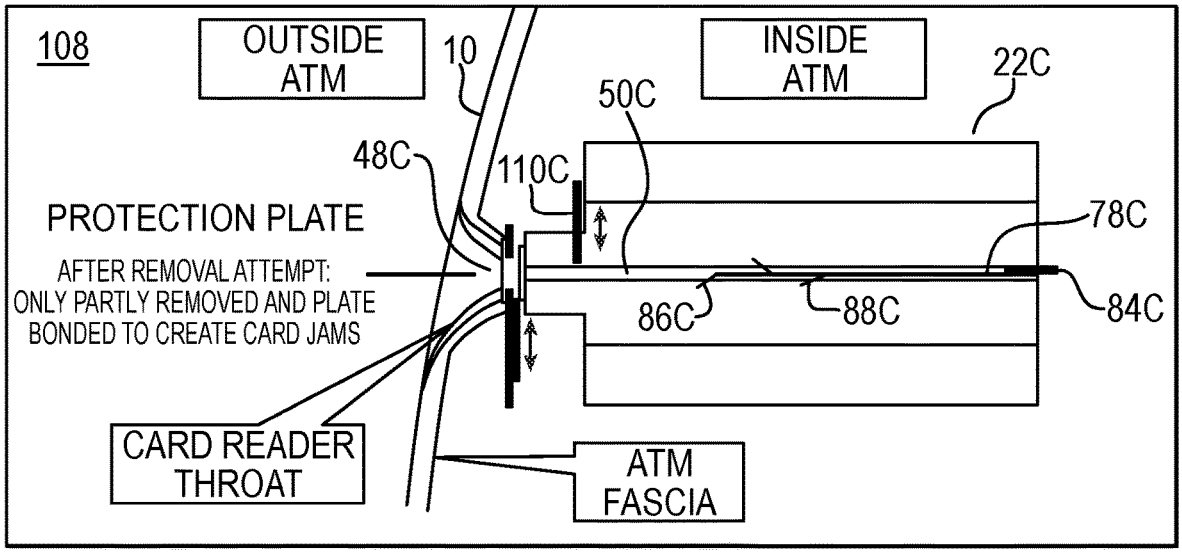

There is shown in FIG. 6, indicated at reference number 106, an exemplary situation prior to a bad actor's attempt to access the interior of the ATM 10, where a plate 78C is within a card reader 22C and adjacent to a card path 50C. The card reader 22C has a shutter 110C which opens and closes, permitting access to a user-card-insertion slot 48C and to a card path 50C. The plate 78C contains a break zone 90C and bend zones 86C and 88C. Indicated at reference number 108 is an exemplary situation after a bad actor's attempt to access the interior of the card reader 22C and pull the plate 78C out of the card reader 22C through the user-card-insertion slot 48C. As depicted at reference number 108C, the front portion of the plate 78C has broken off at the break zone 90C and has bent at the bend zones 86C and 88C and the remaining portion of the plate 78C remains in the card path 50C, with the relatively-wide tab 84C remaining in place at the back of card reader 22C. The above embodiments are merely exemplary and the size, location, number, and other characteristics of bend zones, break zones, etc. may be altered as circumstances require. For example, bend zones and break zones could overlap, and/or a bend zone could bend and ultimately break. Further, for example, a break zone could break or first bend and then break. For further example, the break zone 90C may be structured such that the plate 78C will break along the longitudinal axis of the plate 78C, leaving both relatively long broken sections of the plate 78C within the card reader 22C.

Figure 7:
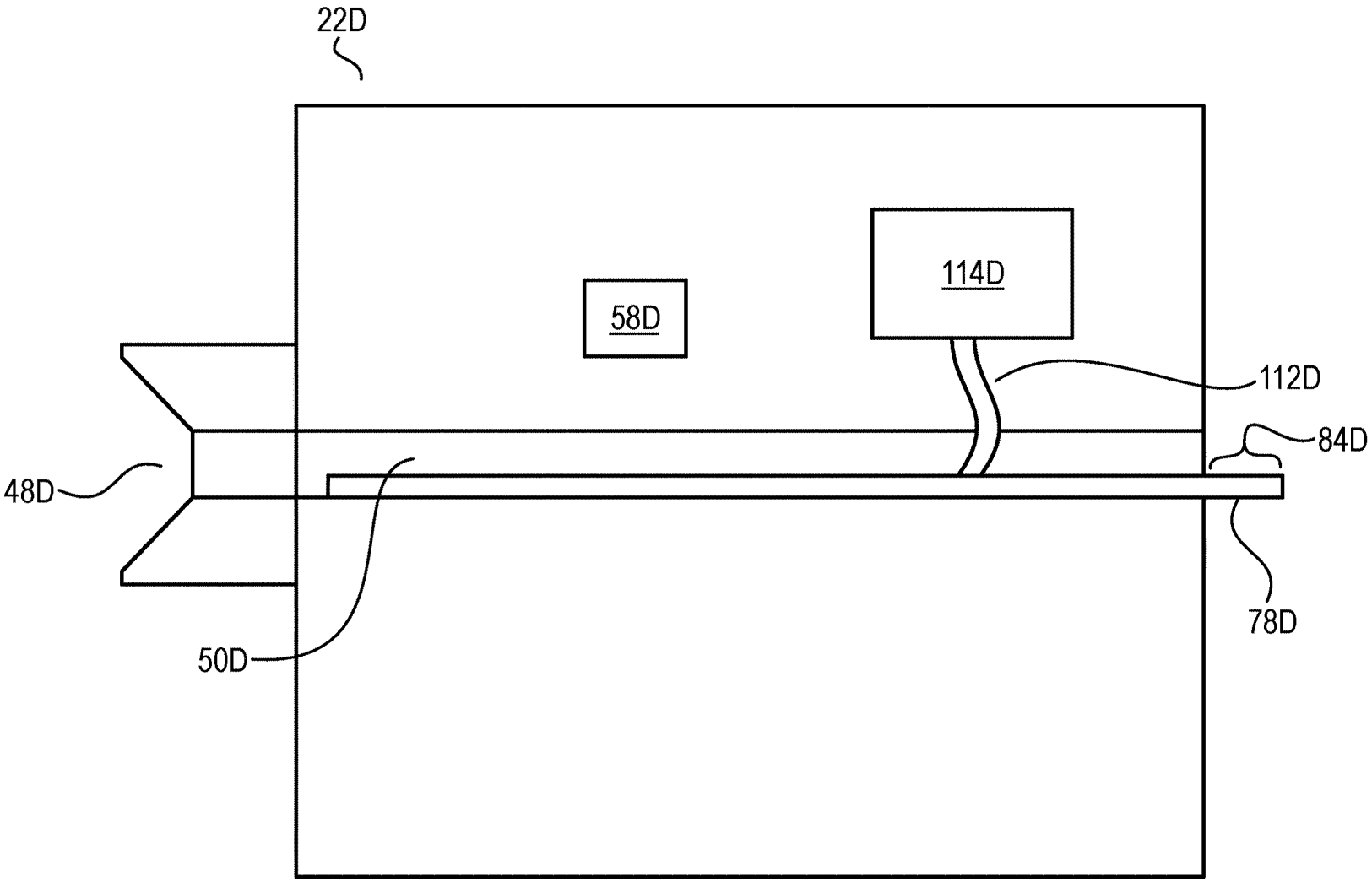
FIG. 7 is a schematic side view of another embodiment of the card reader of FIG. 6.
Figure 8A:
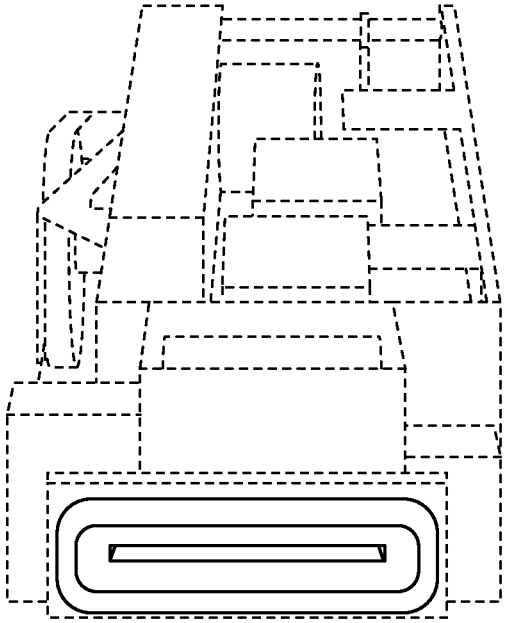
FIG. 8A is a front-top perspective view of another embodiment of the card reader of FIG. 7.
Figure 8B:
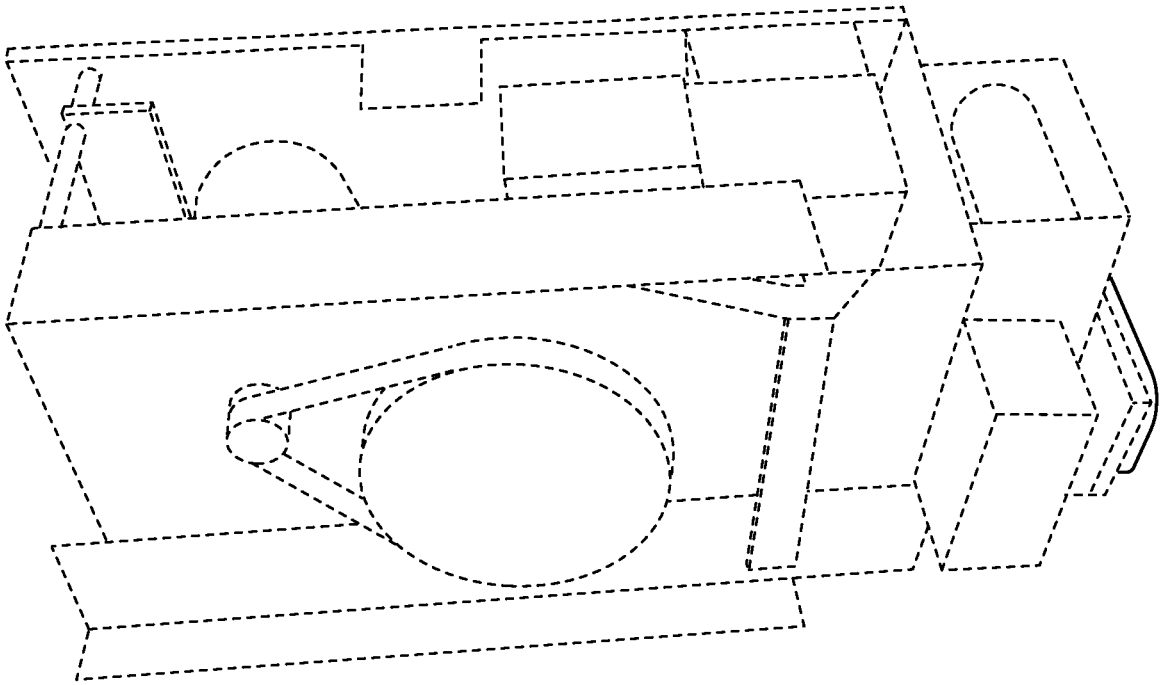
FIG. 8B is a top-right side perspective view of the card reader of FIG. 8A.
Figure 8C:
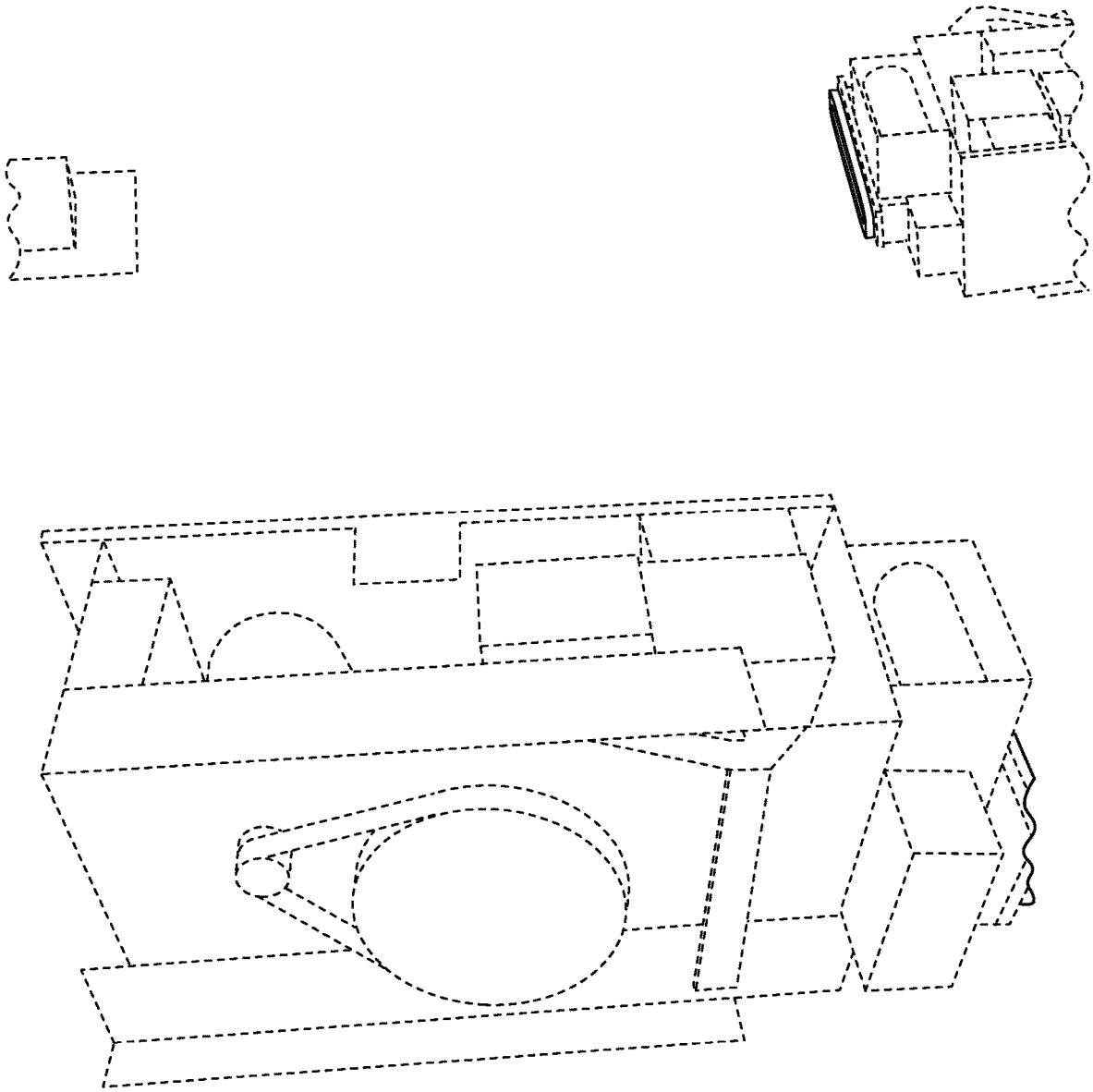
FIG. 8C is a top-right side perspective view similar to FIG. 8B of the card reader of FIG. 8A.
Figure 8D:
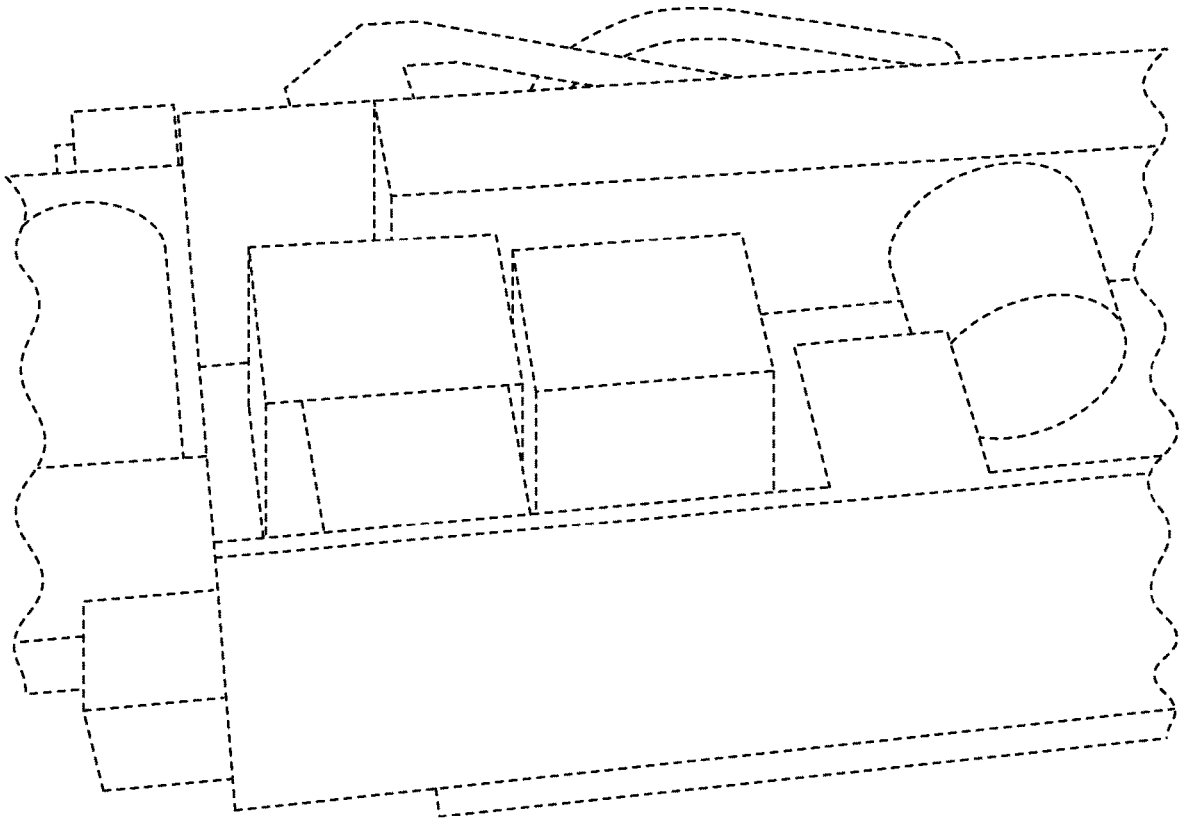
FIG. 8D is a top-left side perspective view of a portion of the card reader of FIG. 8A.
Figure 8E:
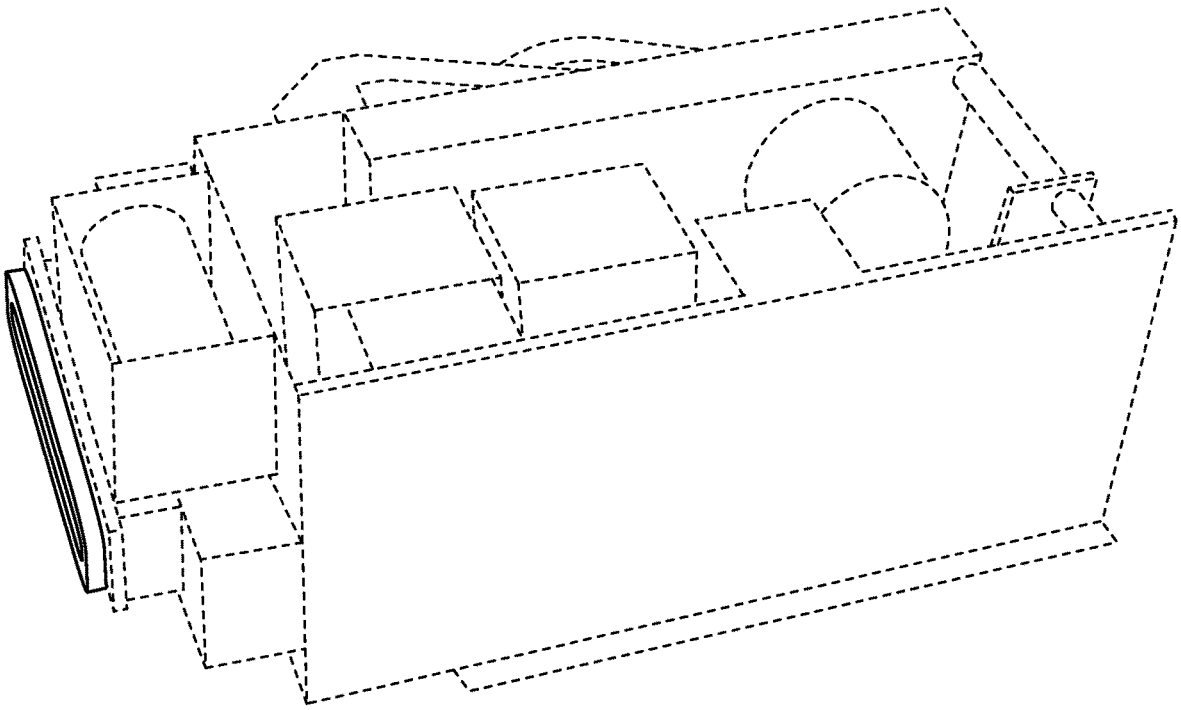
FIG. 8E is a top-left side perspective view similar to FIG. 8D of a portion of the card reader of FIG. 8A.

There is shown in FIG. 7 a card reader 22D that includes a user-card-insertion slot 48D operatively connected to a card path 50D, which includes space in the interior of the card reader 22D sufficient for the insertion of a user card. The card reader 22D also includes a plate 78D located in the interior of the card reader 22D below the card path 50D. The plate 78D is located adjacent to the data reader 58D (for example, a card-reading head) and to the user-card-insertion slot 48D. The plate 78D is configured to block insertion of a skimming or shimming device into placed within the card reader 22D that are covered by the plate 78D. In addition, the plate 78D is operatively connected to a circuit supplying power to the card reader 22D, which is depicted in FIG. 7 by cable 112D and power supply 114D. The card reader 22D is configured such that the connection between the plate 78A and the circuit supplying power to the card reader 22D is broken during an attempt to remove the plate 78D from the interior of the card reader 22D. For example, the cable 112D or a connection between the cable 112D and the power 114D may be severed from power supply 114D due to the pulling of the plate 78D by the bad actor and/or bending or breaking of the plate 78D during an attempt to pull the plate 78D out of the card reader 22D. The card reader 22D may included within the ATM 10.

FIGS. 8A-8E are photograph of a various views of an exemplary card reader, without exemplary plate 78.

Figure 9:
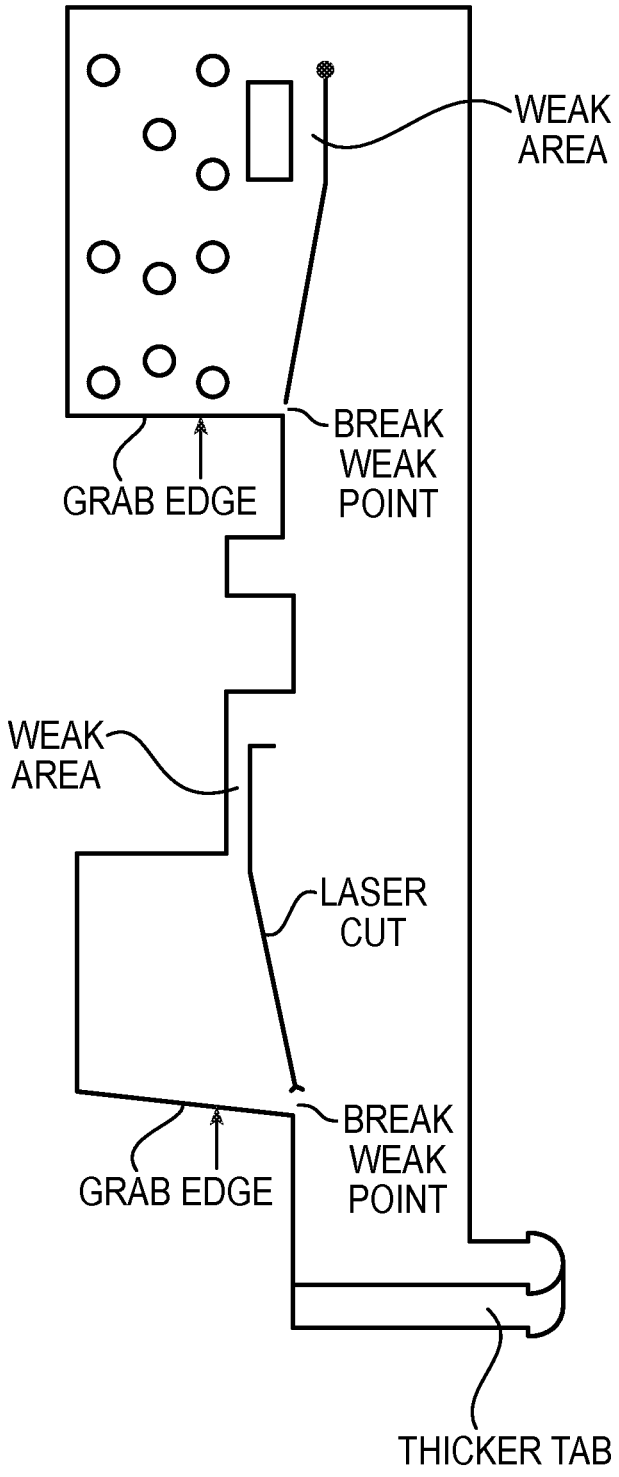
FIG. 9 is a top schematic diagram of another embodiment of a plate similar to the plate of FIG. 4.
Figure 10:
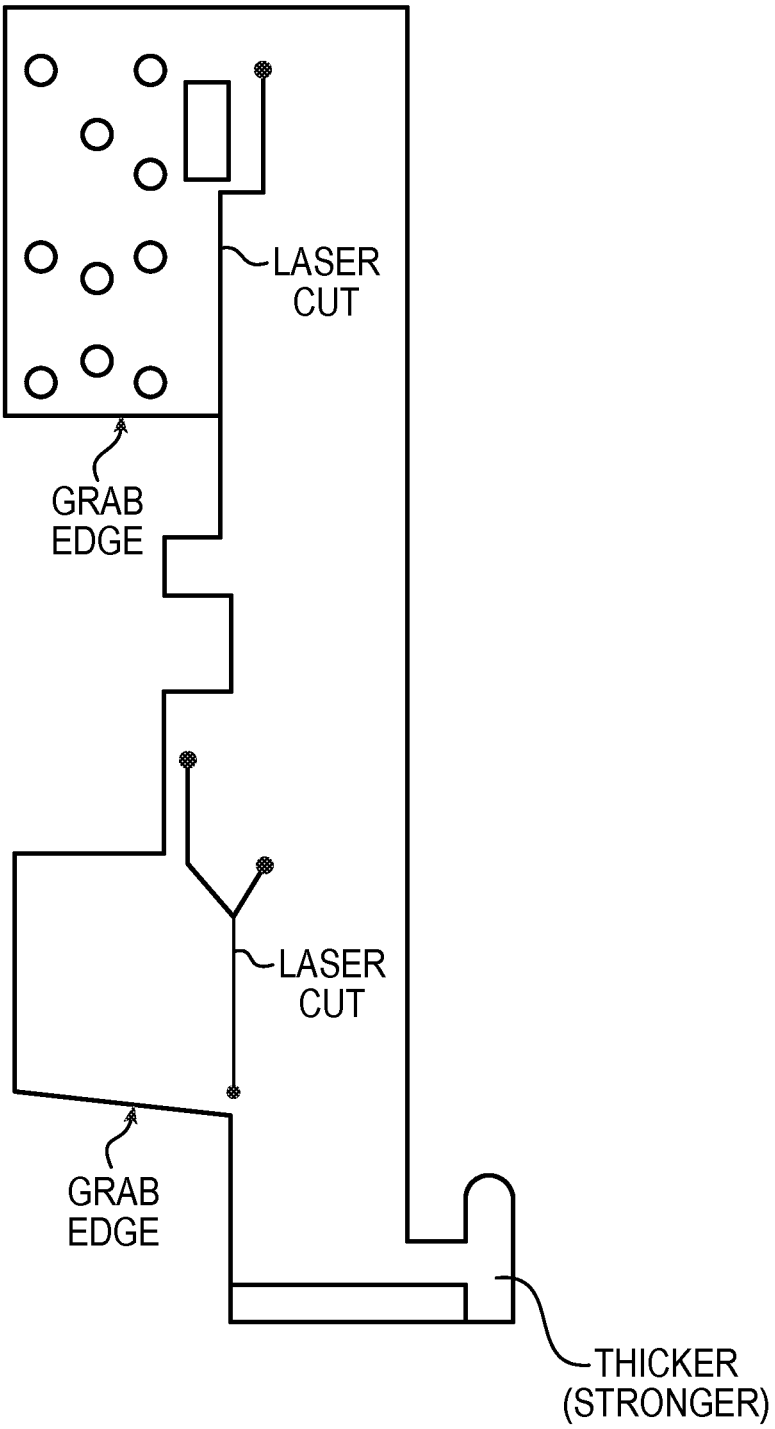
FIG. 10 is a top schematic diagram of another embodiment of a plate similar to the plate of FIG. 5.

FIGS. 9 and 10 show additional embodiments of exemplary plates similar to FIGS. 4 and 5.

Further, a method of securing a card reader includes providing a card reader and a plate with at least one bending zone is placed within the card reader. The plate is placed adjacent to a data-reader and a user card path within the card reader. The plate is configured to block the insertion of a skimming or shimming device in crevices in the card reader covered up by the plate. When an attempt is made to pull the plate out of the front of the card reader, the plate bends at its bend zone, causing the card reader to become inoperable. Additionally, the method may include the card reader jamming due to the bending of the plate. Further, the method may include a portion of the plate breaking when an attempt it made to remove the plate from the interior of the card reader.

Further, a method of securing a card reader includes providing a card reader and a plate. The plate is placed in a card reader adjacent to a data-reader and a user-card path. The method further includes operatively connecting the plate is to a circuit supplying power to the card reader, the plate being configured to block insertion of a skimming or shimming device and to break the connection between the plate and the circuit supplying power to the card reader during an attempt to remove the plate from the interior of the card reader.

While principles and modes of operation have been explained and illustrated with regard to particular embodiments, it must be understood, however, that this may be practiced otherwise than as specifically explained and illustrated without departing from its spirit or scope.

What is claimed is:

1. A card reader comprising:

a data-reader located in an interior of the card reader;

a user-card-insertion slot operatively connected to a user-card path providing a pathway for a user-card between an exterior of the card reader and the data-reader; and a plate disposed in the interior of the card reader adjacent to the data-reader and to the user-card path;

where the plate is configured to block insertion of a skimming or shimming device into the interior of the card reader; and where the plate is configured to bend when force is applied to attempt to remove the plate from the interior of the card reader.

2. The card reader of claim 1 where the plate includes at least one bend zone.

3. The card reader of claim 2 where the bend zone includes perforations formed in the plate.

4. The card reader of claim 2 where the bend zone includes micro-holes formed in the plate.

5. The card reader of claim 2 where the bend zone includes an area that is thinner than a remainder of the plate.

6. The card reader of claim 2 where the plate is configured with the bend zone and disposed in the card reader such that a portion of the plate breaks when force is applied in an attempt to remove the plate from the interior of the card reader.

7. The card reader of claim 1 where the plate is configured such that removal of the plate renders the card reader out-of-service.

8. The card reader of claim 2 where the card reader is configured to become inoperable in response to a bending of the plate at the bend zone.

9. The card reader of claim 1 where the plate is electrically connected into a circuit supplying power to the card reader, and where upon deformation of the plate the circuit is broken.

10. The card reader of claim 1 where the plate is electrically connected into the circuit by a cable.

11. An automated transaction machine comprising:

a housing;

a fascia mounted to the housing; and a card reader mounted in the housing, the card reader including:

a data-reader disposed in an interior of the card reader;

a user-card-insertion slot operatively connected to the fascia and to a user-card path for passage of a user-card between the exterior of the card reader and the data-reader; and a plate disposed in the interior of the card reader adjacent to the data-reader and the user-card path;

where the plate is configured to block insertion of a skimming or shimming device into the interior of the card reader; and where the plate is configured to bend when force is applied in an attempt to remove the plate from the interior of the card reader.

12. The automated transaction machine of claim 10 where the place is configured to bend at a pre-weakened area of the plate.

13. The automated transaction machine of claim 11 where upon bending at the pre-weakened area the card reader is unserviceable.

14. The automated transaction machine of claim 12 where upon bending at the pre-weakened area the card reader becomes inoperable.

15. The automated transaction machine of claim 11 where the plate is electrically connected into a circuit supplying power to the card reader, and where upon deformation of the plate the circuit is broken.

16. The card reader of claim 15 where the plate is electrically connected into the circuit by a cable.

17. A method of securing a card reader comprising:

providing a card reader including:

a data-reader disposed in an interior of the card reader; and a user-card-insertion slot connected to a user-card path for passage of a user-card between the exterior of the card reader and the data-reader;

providing a plate including a pre-weakened area defining a bend zone for bending of the plate; and placing the plate in the interior of the card reader adjacent the data reader and adjacent the user-card path;

where the plate blocks insertion of a skimming or shimming device into the interior of the card reader; and where the plate deforms in the bend zone upon application of a force in an attempt to remove the plate from the interior of the card reader.

18. The method of claim 17 further comprising:

electrically connecting the plate into a circuit supplying power to the card reader;

where upon deformation of the plate the circuit is broken.

* * * * *